United States Patent [19]

Grange

[11] Patent Number: 5,009,003

[45] Date of Patent: Apr. 23, 1991

[54] RAZOR

[75] Inventor: Kenneth Grange, London, England

[73] Assignee: Wilkinson Sword Gesellschaft mit beschränkter Haftung, Solingen, Fed. Rep. of Germany

[21] Appl. No.: 400,660

[22] Filed: Aug. 31, 1989

[30] Foreign Application Priority Data

Sep. 3, 1988 [DE] Fed. Rep. of Germany ..... 8811140

[51] Int. Cl.[5] ..... B26B 19/00; B26B 21/10

[52] U.S. Cl. ..... 30/30; 30/53; 30/88

[58] Field of Search ..... 30/30–32, 30/53–55, 83–89

[56] References Cited

U.S. PATENT DOCUMENTS

| | | | |
|---|---|---|---|
| 823,134 | 6/1906 | Mihills . | |
| 870,826 | 11/1907 | Henry et al. . | |
| 1,187,441 | 6/1916 | Miller . | |
| 1,359,666 | 11/1920 | Brandt | 30/30 |
| 1,500,953 | 7/1924 | Masters | 30/30 |
| 3,409,981 | 11/1968 | Beverly | 30/30 |
| 4,344,226 | 8/1982 | Blake, III . | |

FOREIGN PATENT DOCUMENTS

| | | |
|---|---|---|
| 191999 | 12/1906 | Fed. Rep. of Germany . |
| 8313572 | 10/1983 | Fed. Rep. of Germany . |
| 8222643 | 1/1984 | Fed. Rep. of Germany . |
| 2617079 | 6/1987 | France . |

*Primary Examiner*—Douglas D. Watts
*Attorney, Agent, or Firm*—Robert W. Becker & Associates

[57] ABSTRACT

A razor comprising an elongated handle, at the front end of which is disposed a razor blade, and on that side of the handle opposite the cutting edge of the razor blade, in the vicinity of but spaced from the rear end of the handle, a projecting handle extension. To improve the handle extension of known razors, and in particular to thereby provide a razor having good ergonomic properties, the handle extension is embodied as a short stub extension that is fixedly disposed on the handle.

7 Claims, 2 Drawing Sheets

RAZOR

BACKGROUND OF THE INVENTION

The present invention relates to a razor comprising an elongated handle, at the front end of which is disposed a razor blade, and on that side of the handle opposite the cutting edge of the razor blade, in the vicinity of but spaced from the rear end of the handle, a projecting handle extension.

Razors of this general type are known and are used in particular by hairdressers and barbers. The known razors comprise an elongated handle, at the front end of which is disposed a razor blade that after use can be replaced by a new one. Pivotably mounted in the vicinity of but spaced from the rear end of the handle is a U-shaped cover strip. In the folded-together state of the razor, the cutting edge of the razor blade comes to rest within this cover strip. To use the razor, the cover strip is folded upwardly by more than 180°, so that it forms a projecting handle extension, relative to which a user holds the handle of the razor on both sides with his fingers.

With this heretofore known razor, the cover strip is technically complicated, and hence the razor as a whole is expensive. Furthermore, the projecting handle extension in the form of the cover strip cannot be ergonomically optimized, since the razor must again be folded together or collapsed. Finally, the angular position of the cover strip in the upwardly folded state can easily change, which is disruptive and annoying, especially when shaving.

It is therefore an object of the present invention to improve the handle extension of the heretofore known razor, and in so doing to in particular provide a razor having good ergonomic properties, i.e. a razor that is easy to grasp, safe to handle, and easy to guide while shaving.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
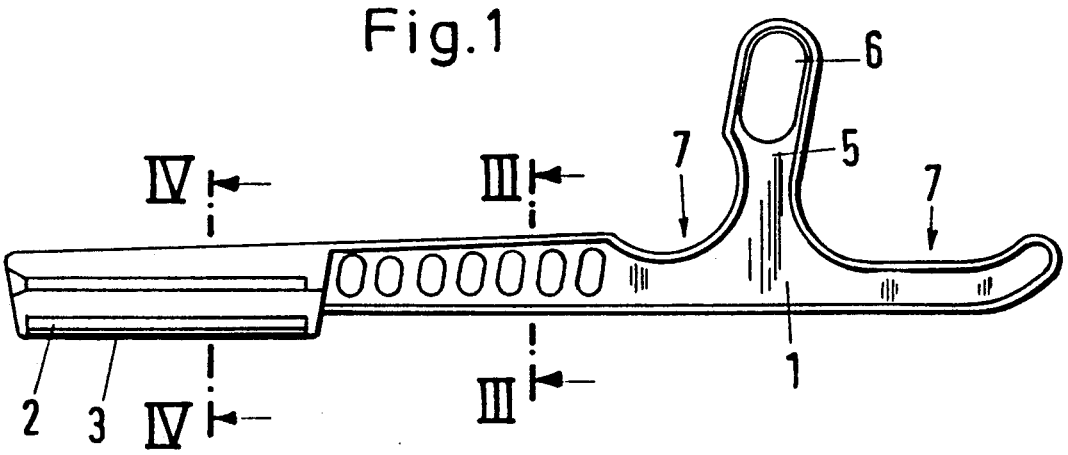
FIG. 1 shows one exemplary embodiment of the inventive razor.

The razor of the present invention is characterized primarily in that the handle extension is embodied as a short stub extension that is fixedly disposed on the handle.

A razor constructed pursuant to the present invention is characterized by very good ergonomic properties. The short stub extension, which is fixedly disposed on the handle, can be embodied in such a way that the user can hold the handle of the razor in an ergonomically optimum manner. The term "short" as used in connection with the length of the stub extension refers essentially to an order of magnitude that conforms to the thickness of the fingers, so that the fingers can rest comfortably on the side of the stub extension. Thus, the length of the stub extension can, for example, be equal to the thickness of two to three fingers. Since the short stub extension is fixedly disposed on the handle, the angular position thereof relative to the handle cannot change, so that the user can safely and reliably hold the razor.

The stub extension is preferably integrally embodied with the handle, whereby the handle and the stub extension are preferably a molded plastic part. This represents a razor that is technically very straightforward to manufacture.

Pursuant to a further development of the inventive stub extension, the latter can be provided with an opening. In addition to saving material, this opening can serve as a hanger means for the razor.

In order to improve the ergonomic gripping properties of the razor, it is proposed pursuant to a further specific embodiment of the present invention that the elongated handle be provided with a respective depression, which extends in the longitudinal direction of the handle, preferably on both sides of the stub extension. The fingers of the user then come to rest in these depressions in such a way that they do not slide. Depending upon the configuration of the depressions, an appropriate number of fingers can be accommodated therein.

In order to increase the stability of the razor on the whole, and in particular of the handle, pursuant to another specific embodiment of the present invention the handle has a double T profile. Such a cross-sectional profile in the form an "H" that is resting on its side has proven to be very advantageous for a high stability.

In principle, it is possible to use a so-called razor blade unit for the razor blade of the razor. With such a razor blade unit, the razor blade is fixedly disposed in a plastic body, with the razor blade unit, as a separate component, being connected to the front end of the handle and possibly being replaceable with a new unit after the razor blade has become dull, in which case the handle is reused. In so doing, the razor blade units can be arranged in a dispenser, from which they can be removed via the handle. Alternatively, however, pursuant to a further development of the inventive razor, it is possible to have a one-piece molded plastic part where the razor blade is fixedly disposed in the handle. A razor embodied in this manner is a so-called disposable razor that is thrown away when the razor blade becomes worn. Since in contrast to the previous arrangement where a cover strip was pivotably mounted on the handle, the inventive razor merely has an integrally formed-on short stub extension, the inventive razor is economical to replace without great cost to the user. In particular, this disposable use satisfies regulations that require hairdressers and barbers to use a new razor for each customer in order to satisfy hygiene requirements.

Pursuant to a further specific embodiment of the inventive razor, a protective cap is proposed for the front end of the handle to cover the cutting edge of the razor blade. Such a cap has the advantage that a person cannot injure himself during nonuse of the razor.

Pursuant to a first specific embodiment of the protective cap, the latter is preferably a U-shaped clamping member that either is placed on the handle from the front in the longitudinal direction of the handle, or is placed on the handle in the direction perpendicular to the cutting edge of the razor blade. In so doing, due to the preloading of the U-shaped protective cap, the facing inner walls of the cap come to rest against the sides of the handle, thereby fixing the cap relative to the handle.

Pursuant to a second specific embodiment of the protective cap, it is proposed that this cap be a bag-like plastic foil that can be placed upon the front end of the handle in the longitudinal direction thereof. Such a plastic foil is particularly economical for throw-away razors, since after a single use of the razor, the foil and the razor are thrown away anyway.

Further specific features of the present invention will be described in detail subsequently.

DESCRIPTION OF PREFERRED EMBODIMENTS

Figure 3:
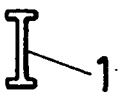
FIG. 3 is a cross-sectional view taken along the line III—III in FIGS. 1 and 2.
Figure 4:
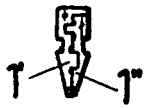
FIG. 4 is a cross-sectional view taken along the line IV—IV in FIG. 1.
Figure 5:
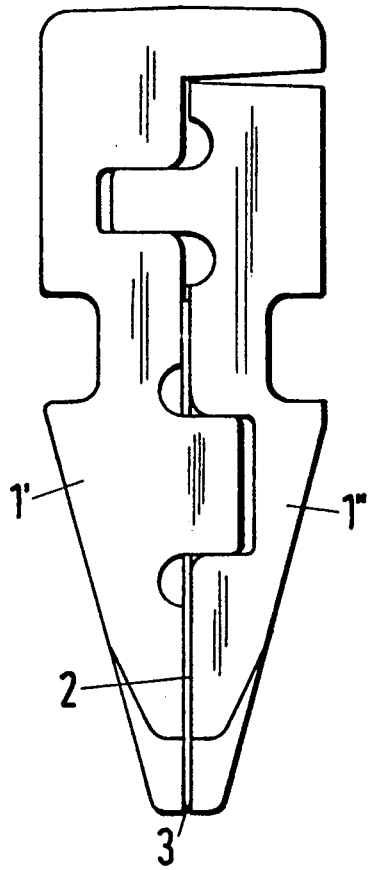
FIG. 5 is an enlarged view of FIG. 4.
Figure 6:
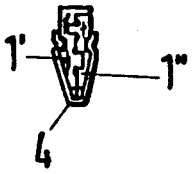
FIG. 6 is a cross-sectional view taken along the line VI—VI in FIG. 2.
Figure 7:
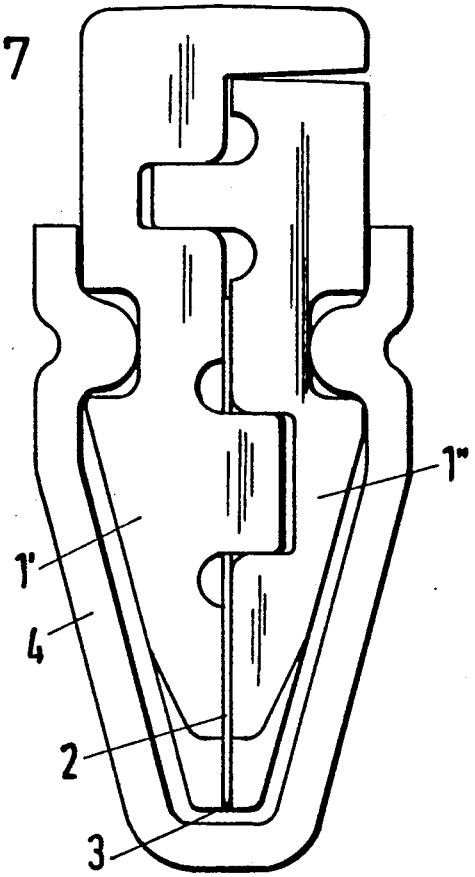
FIG. 7 is an enlarged view of FIG. 6.

Referring now to the drawings in detail, the inventive razor comprises an elongated grip or handle 1 that has a double-T-shaped cross-sectional profile, as can be seen from the cross-sectional view of FIG. 3. The handle 1 is a molded plastic part in which, at the front end of the handle 1, a razor blade 2 is fixedly disposed, so that the razor blade 2, with the exception of the cutting edge 3 thereof, is laterally completely covered by the plastic material. As can be seen in the cross-sectional views of FIGS. 4 to 7, the handle 1 comprises two individual molded plastic parts 1' 1" which, accompanied by the interposition of the razor blade 2 therebetween, are connected with one another. For this purpose, in the illustrated embodiment the two molded plastic parts 1', 1" are provided with pegs and corresponding recesses. It is to be understood that instead of two individual molded plastic parts 1' and 1", a single molded plastic part could also be provided in which the razor blade 2 is disposed during the injection molding or extrusion process.

When the razor is not being used, a protective cap is placed upon the front end of the handle 1 to cover the cutting edge 3 of the razor blade 2. In the illustrated embodiment, the cap 4 is a clamping member that can engage or catch and that has a V-shaped cross-sectional profile, as can be seen from FIGS. 2, 6, and 7. Alternatively, a bag-like plastic foil could also be provided as a cap 4, with such a foil being adapted to be placed on in the longitudinal direction of the handle 1 to sheathe the front end thereof.

Formed in the rear portion of the handle 1 is a short stub extension 5, which is formed on that side of the handle 1 that is opposite the cutting edge 3 of the razor blade 2. This stub extension 5, which is integrally formed with t he handle 1, forms a very definite angle with the handle.

Figure 2:
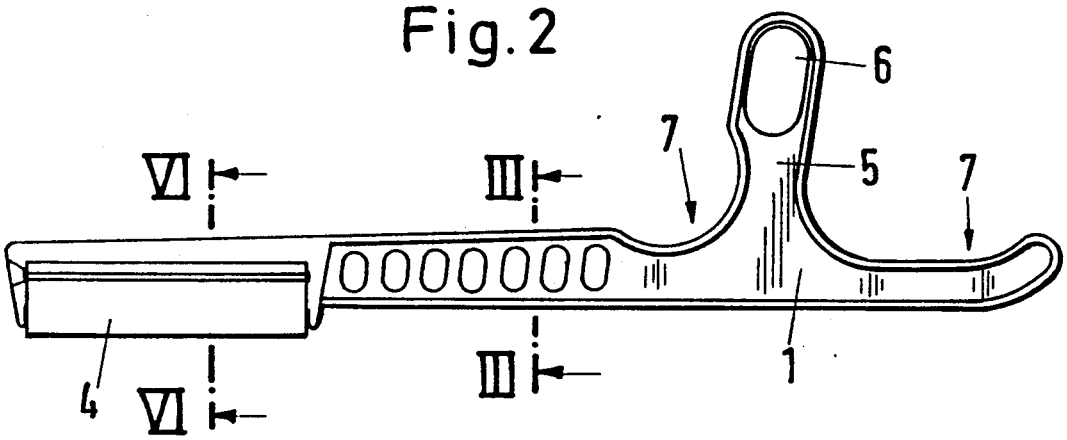
FIG. 2 shows the razor of FIG. 1, however with a protective cap placed thereon for the razor blade.

As can furthermore be seen from FIGS. 1 and 2, the stub extension 5 is provided with an opening 6, which on the one hand serves to eliminate material, and on the other hand serves as a hanger means for the razor. FIGS. 1 and 2 also show that a respective depression 7, which extends in the horizontal direction, is disposed on each side of the stub extension 5 for receiving fingers of the user.

The razor of the present invention is characterized by its good ergonomic properties, and can furthermore be used as a so-called throw-away or disposable razor.

The present invention is, of course, in no way restricted to the specific disclosure of the specification and drawings, but also encompasses any modifications within the scope of the appended claims.

I claim:

1. In a razor comprising an elongated handle which has a front end and a rear end, at said front end of which is disposed a razor blade having a cutting edge, and also comprising, on that side of said handle opposite said cutting edge of said razor blade, in the vicinity of but spaced from said rear end of said handle, a projecting handle extension, the improvement wherein:

said handle extension is embodied as a short stub extension that is fixedly disposed on said handle, with said stub extension being integral with said handle and being provided with an opening, whereby depression means that extend in the longitudinal direction of said elongated handle are disposed on at least one side of said stub extension; and said handle has a double T profile.

2. A razor according to claim 1, in which said depression means includes two depressions, one on each side of said stub extension.

3. A razor according to claim 1, which is a one-piece molded plastic part, with said razor blade being fixedly disposed in said handle.

4. A razor according to claim 1, which comprises two molded plastic parts between which said razor blade is sandwiched, with said stub extension being integral with one of said molded parts.

5. A razor according to claim 1, which includes a protective cap for said front end of said handle to cover said cutting edge of said razor blade.

6. A razor according to claim 5, in which said protective cap is a U-shaped clamping member.

7. A razor according to claim 5, in which said protective cap is a bag-like plastic foil that is adapted to be placed on said front end of said handle in a longitudinal direction.

* * * * *